United States Patent [19]

Damji

[11] Patent Number: 4,841,333

[45] Date of Patent: Jun. 20, 1989

[54] PROCESS UNIT FOR AN IMAGING APPARATUS

[75] Inventor: Dhirendra Damji, Biggleswade, England

[73] Assignee: Xerox Corporation, Stamford, Conn.

[21] Appl. No.: 204,827

[22] Filed: Jun. 10, 1988

[30] Foreign Application Priority Data

Aug. 19, 1987 [GB] United Kingdom ..... 8719545

[51] Int. Cl.[4] ..... G03G 5/00; G03G 15/08

[52] U.S. Cl. ..... 355/211; 355/260; 355/215

[58] Field of Search ..... 355/3 R, 3 DR, 3 BE, 355/71, 3 DD

[56] References Cited

U.S. PATENT DOCUMENTS

| | | | |
|---|---|---|---|
| 3,985,436 | 10/1976 | Tanaka et al. | 355/8 |
| 4,460,267 | 7/1984 | Ogawa | 355/3 DD |
| 4,462,677 | 7/1984 | Onoda et al. | 355/3 R |
| 4,540,268 | 9/1985 | Toyono et al. | 355/3 R |
| 4,575,221 | 3/1986 | Onoda et al. | 355/3 R |
| 4,583,832 | 4/1986 | Kasamura et al. | 355/3 DD |
| 4,588,280 | 5/1986 | Ogawa et al. | 355/3 R |
| 4,591,258 | 5/1986 | Nishino et al. | 355/3 R |
| 4,598,993 | 7/1986 | Mizutani et al. | 355/3 R |
| 4,737,817 | 4/1988 | Kando et al. | 355/3 DR |

FOREIGN PATENT DOCUMENTS

| | | |
|---|---|---|
| 0101325 | 2/1984 | European Pat. Off. . |
| 57-211181 | 12/1982 | Japan . |

*Primary Examiner*—A. C. Prescott

[57] ABSTRACT

A xerographic cassette adapted to be removably mounted in a main assembly of a printing machine comprises a cassette housing containing a photoreceptor, a housing for containing developer, and an aperture through which the photoreceptor may be exposed to light. A retactable sealing shutter is provided for sealing the developer housing, and a retractable opaque shutter is provided for closing the aperture, the two shutters being linked to form a unitary member which is slideably mounted in the cassette housing. The unitary member cooperates with an actuator mounted on the main assembly of a copier in such manner that the opaque shutter and the sealing shutter are moved together to positions at which they respectively close the aperture and the seal the developer chamber when the process unit is removed from the main assembly, and the opaque shutter and the sealing shutter are moved together to positions at which the aperture and the developer chamber respectively are open when the process unit is inserted in the main assembly of the copier. Suitably, the sliding unitary member is made of plastic and molded as a one-piece unit.

16 Claims, 4 Drawing Sheets

PROCESS UNIT FOR AN IMAGING APPARATUS

CROSS REFERENCE TO RELATED APPLICATIONS

Reference is made to the following copending applications filled Dec. 10, 1987: Application Ser. No. 131,163 entitled "Process Unit Incorporation A Charging Device" in the name of Alan C. R. Howard Et al. Application Ser No. 131,162 entitled "Process Unit For An Imaging Apparatus" in the name of Robert. A. Carter Application Ser. No. 131,075 entitled "Process Unit For An Imaging Apparatus" in the name of Alan C. R. Howard et al; Application Ser. No. 131,074 entitled "Process Unit For An Imaging Apparatus" in the name of Alan C. R. Howard et al; Application Ser. No. 130,920 entitled "Electrostatographic Reproducing Machine and Process Unit Therefore" in the name of David M. Newbury and Application Ser. No. 131,073 entitled "Fibre Traps In Copiers" in the name of Philip R. Thompson Reference is also made to copeding Application Ser. No. 038,093 entitled "Process Unit For An Imaging Apparatus" filed April 14, 1987 in the name of Robert A. Carter.

BACKGROUND OF THE INVENTION

This invention relates to a process unit adapted to be removably mounted in a main assembly of an electrostatographic printing machine, the unit comprising a housing and an imaging member inside the housing. The invention further relates to an electrostatographic printing machine employing such a process unit.

Conventionally, in the automatic xerographic process, a latent electrostatic image of an original to be reproduced is recorded upon an image retaining member and the image then made visible, or developed, by means of a finely divided particulate toner material. In reusable xerography, the developed toner image is generally transferred from the image retaining member to a copy sheet, such as paper or the like, and the image affixed thereto to form a permanent record of the original input scene information. Although a preponderance of the toner material comprising the developed image is transferred to the copy sheet, a small amount of residual toner is nevertheless invariably left behind on the image retaining member surface after the transfer operation. In order to restore the image retaining member to conditions suitable for reuse, the residual toner must be cleaned or removed from the image retaining member surface before a new imaging cycle is instituted.

PRIOR ART

Recently there has been a trend to incorporate the imaging member, i. e. the photoreceptor, together with other process means such as a charge corotron, a development device, and a cleaning device in a removable process unit or so-called cassette as disclosed for example, in U.S. Pat. No. 3,985,436 to Tanaka et al. The use of such a cassette enables the easy replacement of those parts of the copying machine which are most likely to deteriorate with use, especially the photoreceptor, but also the development and cleaning systems as well as the charge corotron wire. A further advantage of containing the major process elements within a cassette is that interchangeable cassettes may be used in a given copying machine to provide different development characteristics or different colored development.

A problem with the cassette disclosed in U.S. Pat. No. 3,985,436 is that when it is removed from the main assembly of the copying machine the part of the imaging member where exposure to the light image occurs in the copying machined is unprotected and therefore is susceptible to damage or contamination, and also to light exposure which can result in premature deterioration of the photosensitive material on the imaging members. Needless to say, these advese effects are likely to impair the quality of image formation or possibly even severely light shock the imaging member beyond recovery.

With a view to overcoming this problem it has been proposed to provide a cassete with a retractable cover for shielding and protecting the imaging members. For example U.S. Pat. No. 4,588,280 to Ogawa et al and European Patent Application No. 0101325 also to Ogawa et al disclose a cassette with a flap-like shield which is automatically pivoted to a closed position to shield the imaging member when the cassette is removed from the main assembly of the copying machine, and when the cassette is inserted into main assembly the shield is automatically pivoted to an open position to expose the imaging member at the area where imaging occurs. The arrangement is such that the flap remains open during normal operation of the machine.

Also, as mentioned above, the development device may be incorporated inn the cassette housing. In this case, the cassette housing includes a chamber for the developer and a developer roll for dispensing the developer to the imaging member in known manner. Since the developer chamber is inside the cassette housing it is customary for the chamber to remain open even when the cassette is removed from the main assembly of the copying machine because the cassette housing itsel acts to contain the developer and prevent it escaping to the environment. Thus an operator can handle a cassette without the risk of getting developer on his hands or clothes.

It is known in the xerographic art to provide a shutter over the developer chamber of a removable developing device. In particular U.S. Pat. No. 4,460,267 to Agawa discloses an arrangement in which the developer chamber has an opening through which toner is dispensed to an imaging member and a shutter is provided which is pivotally and slideably mounted in such manner that when the developing device is mounted in the copying machine the shutter automatically assumes a position to open the developer chamber, and when the device is withdrawn from the machine the shutter moves to a position to cover the opening in the developer chamber thereby preventing toner from getting onto the operators hands or clothes or otherwise excaping into the surroundings.

A similar developing device is described in U.S. Pat. No. 4,583,832 to Kasamura et al wherein a movable protective cover member for covering and protecting the developing sleeve of a removably mounted developing device is mechanically connected to ta handle for carrying the device and movable from a protecting position to a nonprotecting position and vise versa in response to operation of the handle.

SUMMARY OF THE INVENTION

According to a first aspect of the present invention there is provided a process unit adapted to be removably mounted in a main assembly of an electrostatographic printing machine, comprising a housing, an imaging member inside the housing, which housing has a chamber for containing developer and an aperture through which the imaging member may be exposed to light, an opaque shutter adjacent the aperture, and a sealing shutter adjacent the developer chamber, wherein the opaque shutter and the sealing shutter are linked to form a unitary member which is slideably mounted within the housing and which is adapted to cooperate with actuating means provided on the main assembly of the printer whereby the opaque shutter and the sealing shutter are moved together to positions at which they respectively close the aperture and seal the developer chamber when the process unit is removed from the main assembly, and the opaque shutter and the sealing shutter are moved together to positions at which the aperture and the developer chamber respectively are open when the process unit is inserted in the main assembly of the printing machine.

A process unit in accordance with the invention has the advantage, firstly, that a sealing shutter is automatically moved to a position to close the developer chamber whenever the process unit is removed from the main assembly of the printer, thus preventing toner from escaping into and hence contaminating other parts of the cassette housing. This has been found to be particularly beneficial because in the field, especially during transit for example, a process unit maybe subject to rough handling and the sealing shutter thus acts as an effective transit seal.

Secondly, the sealing shutter is physically linked to th opaque light shutter, and the two shutters are both slideably operated by a single actuating means. This has the advantage of simplifying the overall operating mechanism for the two shutters with consequential cost saving potential. The opaque shutter and the sealing shutter are formed as a unitary member, suitably a one-piece member, which may for example be molded from plastics material.

The opaque shutter and the sealing shutter may be linked by a coupling which is flexible at least in the direction of movement of the shutters, for example a pair of resilient straps. In this way, the two shutters may be moved over different distances despite being physically linked, which is particularly advantageous if the aperture in the development chamber is of a different size to the light exposure aperture in the cassette housing since the shutters may then be made to match closely the dimensions of their respective apertures, thus permitting a particularly compact configuration.

According to a further aspect of the present invention there is provided an electrostatographic copying machine comprising a main assembly and a process unit in accordance with the first aspect of the invention adapted to be removably mounted in the main assembly, the main assembly comprising actuating means adapted to cooperate with the unitary member of the process unit in such manner that the opaque shutter and the sealing shutter are moved together to positions at which they respectively close the aperture and seal the developer chamber when the process unit is removed from the main assembly, and the opaque shutter and the sealing shutter are moved together to positions at which the aperture and developer chamber respectively are open when the process unit is inserted in the main assembly of the copying machine.

BRIEF DESCRIPTION OF THE INVENTION

An embodiment of the invention will now be described, by way of example, with reference to the accompanying drawings in which:

FIG. 1 is a schematic cross section of a xerographic copying machine incorporating a process unit having a pair of linked shutters in accordance with the invention, FIG. 2 is an enlarged cross section of part of the process unit in accordance with the invention with the shutters in their closed positions, FIG. 3 is an enlarged cross section of the part of th process unit in FIG. 2 with the shutters in their open positions, FIG. 4 is a plan view of the shutters in their closed positions, and FIG. 5 is a plan view of the shutters in their open positions.

DETAILED DESCRIPTION OF THE INVENTION

Figure 1:
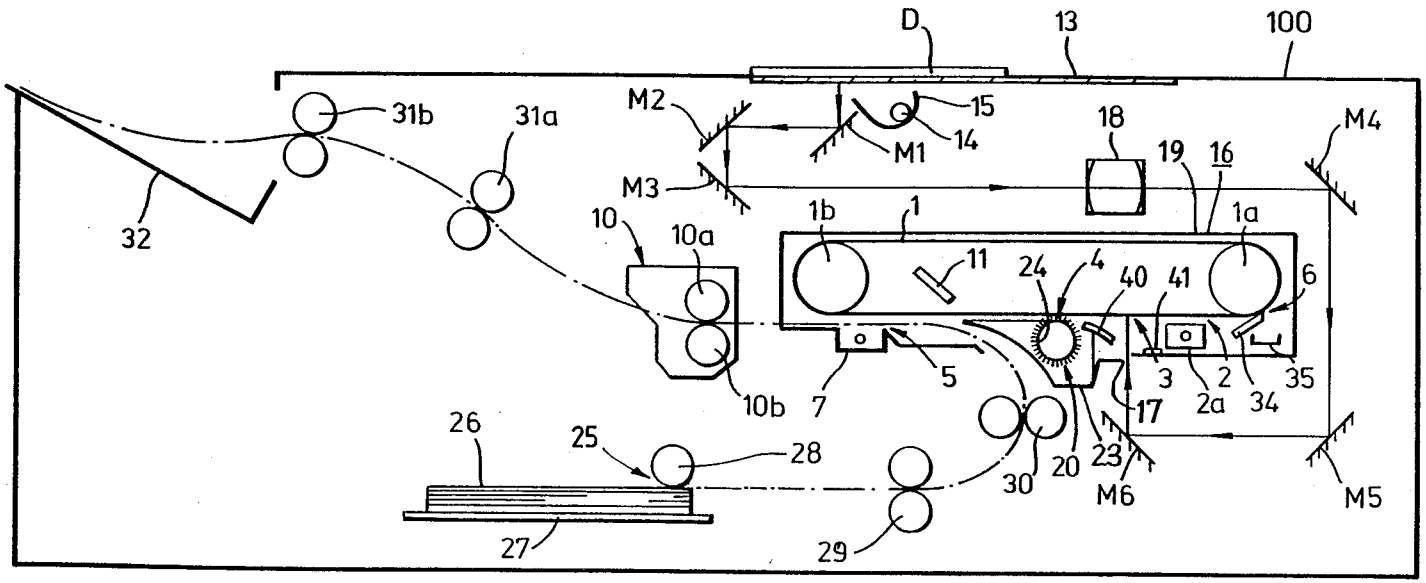

Referring first to FIG. 1, there is shown schematically a xerographic copying machine incorporating the present invention. The machine includes an endless flexible photoreceptor bel 1 mounted for rotation (in the clockwise direction as shown in FIG. 1) about support rollers 1*a* and 1*b* to carry the photosensitive imaging surface of the belt 1 sequentially through a series of xerographic processing stations, namely a charging station 2, an imaging station 3, a development station 4, a transfer station 5, and a cleaning station 6.

The charging station 2 comprises a corotron 2*a* which deposits a uniform electrostatic charge on the photoreceptor belt 1.

An original document D to be reproduced is positioned on a platen 13 and is illuminated in known manner a narrow strip at a time by a light source comprising a tungsten halogen lamp 14. Light from the lamp light source comprising a tunsten halogen lamp 14. Light from the lamp is concentrated by an elliptical reflector 15 to cast a narrow strip of light onto the side of the original document D facing the platen 13. Document D thus exposed is imaged onto the photoreceptor 1 via a system of mirrors M1 to M6 and a focusing lens 18. The optical image selectively discharges the photoreceptor in image configuration, whereby an electrostatic latent image of the original document is laid down on the belt surface at imaging station 3. In order to copy the whole original document the lamp 14, reflector 15, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriage relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 18 along its optical axis closer to the original document i.e. closer to mirrors M2 and M3, for magnification greater then unity and away from the mirrors M2 and M3 for reduction, i.e. magnification less than unity. When the lens 18 is moved, the length of the optical path between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown). At the development station 4, a magnetic brush developer system 20 develops the electrostatic latent image into visible form. Here, toner is dispensed from a hopper (not shown) into developer housing 23 which contains a two-component developer mixture comprising a magnetically attractable carrier and the toner, which is deposited on the charged area of belt 1 by developer roll 24.

The developed image is transferred at transfer station 5 from the belt to a sheet of copy paper which is delivered into contact with the belt in synchronous relation to the image from a paper supply system 25 in which a stack of paper copy sheets 26 is stored on a tray 27. The top sheet of the stack in the tray is brought, as required, into feeding engagement with a top sheet separator/-feeder 28. Sheet feeder 28 feeds the top copy sheet of the stack towards the photoreceptor around a 180° C. path via two sets of nip roll pairs 29 and 30. The path followed by the copy sheet is denoted by a broken line in FIG. 1. At the transfer station 5 a transfer corotron 7 provides an electric field to assist in the transfer of the toner particles thereto. The copy sheet bearing the developed image is then stripped from the belt 1 and subsequently conveyed to a fusing station 10 which comprises a heated roll fuser to which release oil maybe applied in known manner. The image is fixed to the copy sheet by the heat and pressure in the nip between the two rollers 10*a* and 10*b* of the fuser. The final copy is fed by the fuser rolls into catch tray 32 via two further nip roll pairs 31*a* and 31*b*.

After transfer of the developed image from the belt some toner particles usually remain on the surface of the belt, and these are removed at the cleaning station 6 by a doctor blade 34 which scrapes residual toner from the belt. The toner particles thus removed fall into a receptable 35 below. Also, any electrostatic charges remaining on the belt are discharged by exposure to an erasure lamp 11 which provides an even distribution of light across the photoreceptor surface. The photoreceptor is then ready to be charged again by the charging corotron 2*a* as the first step in the next copy cycle.

The photoreceptor belt 1, the charge corotron 2*a*, the developer system 20, the transfer corotron 7, and the cleaning station 6 may all be incorporated in a housing 19 of a process unit or so-called cassette 16 adapted to be removably mounted in the main assembly 100 of the xerographic copier. The cassette 16 has an aperture 17 in the underside of housing 19 through which the light image of document D reflected by the system of mirrors M1 to M6 and focusing lens 18 enters the cassette before impinging on the photoreceptor 1. Also, as described in more detail below with reference to FIGS. 2 to 5, the cassette 16 comprises a transit sealing shutter 40 adjacent the developer housing 23 and an opaque shutter 41 adjacent the aperture 17.

Figure 2:
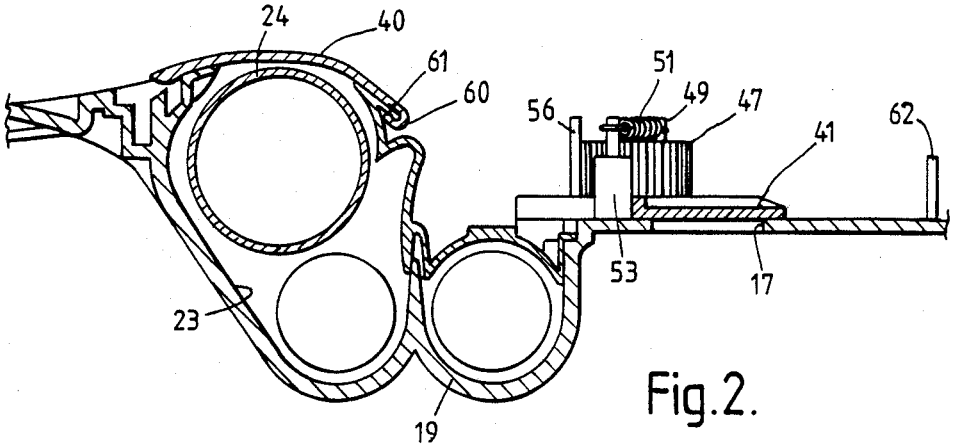
Figure 3:
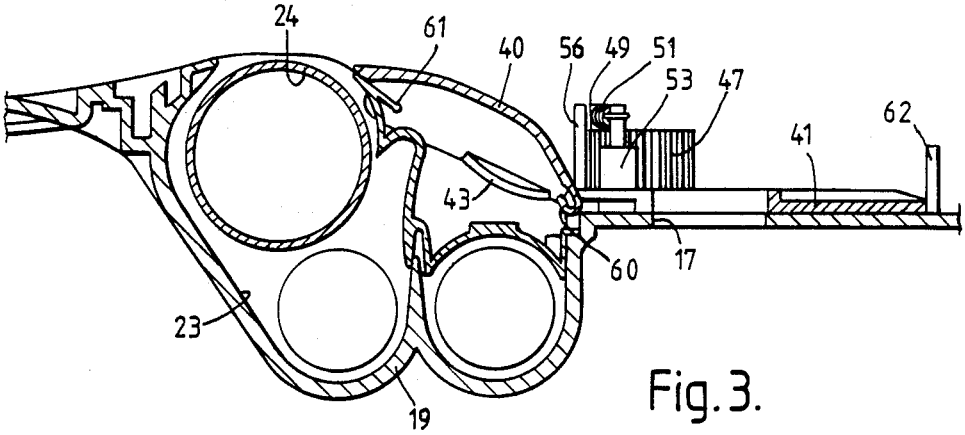
Figure 4:
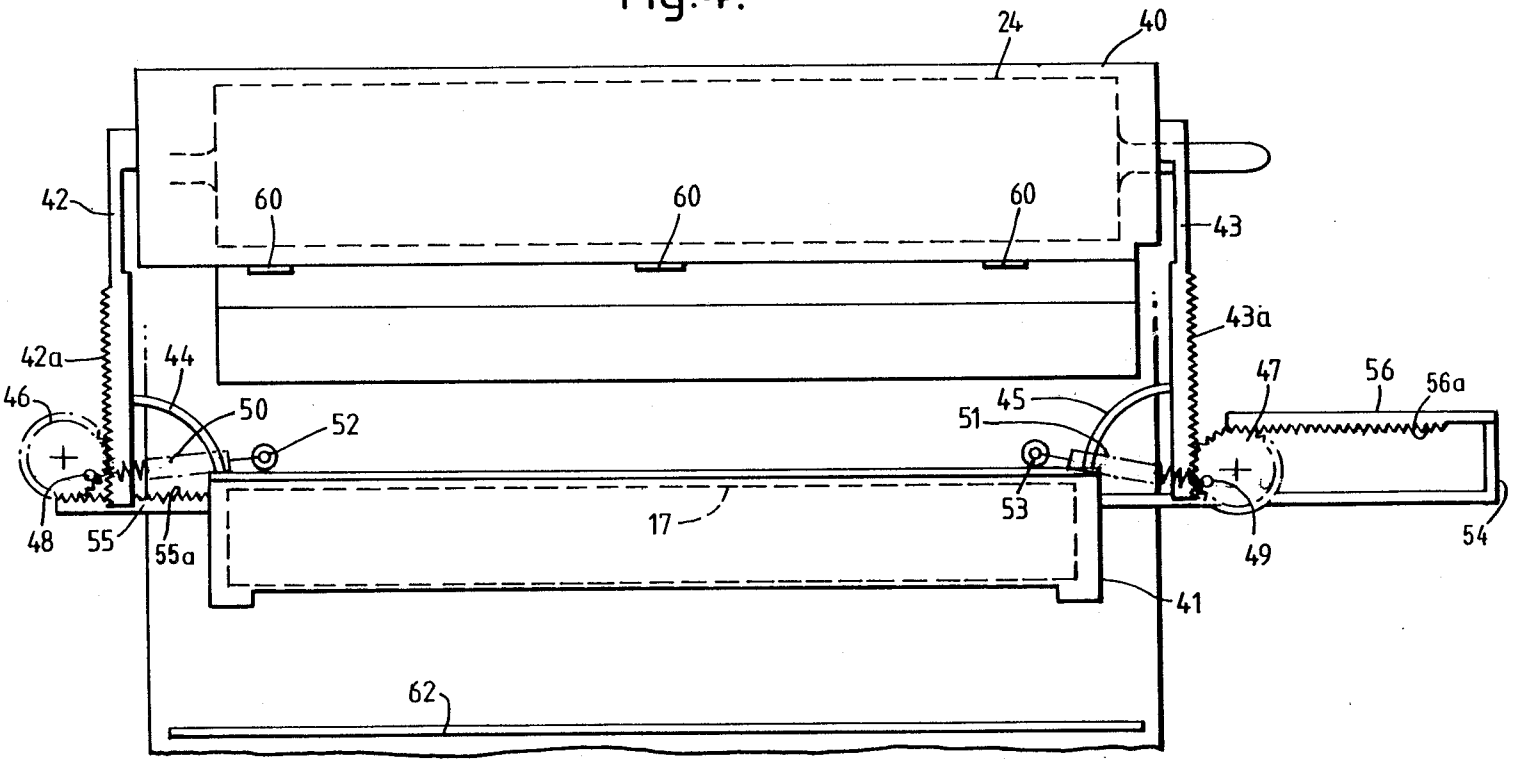
Figure 5:
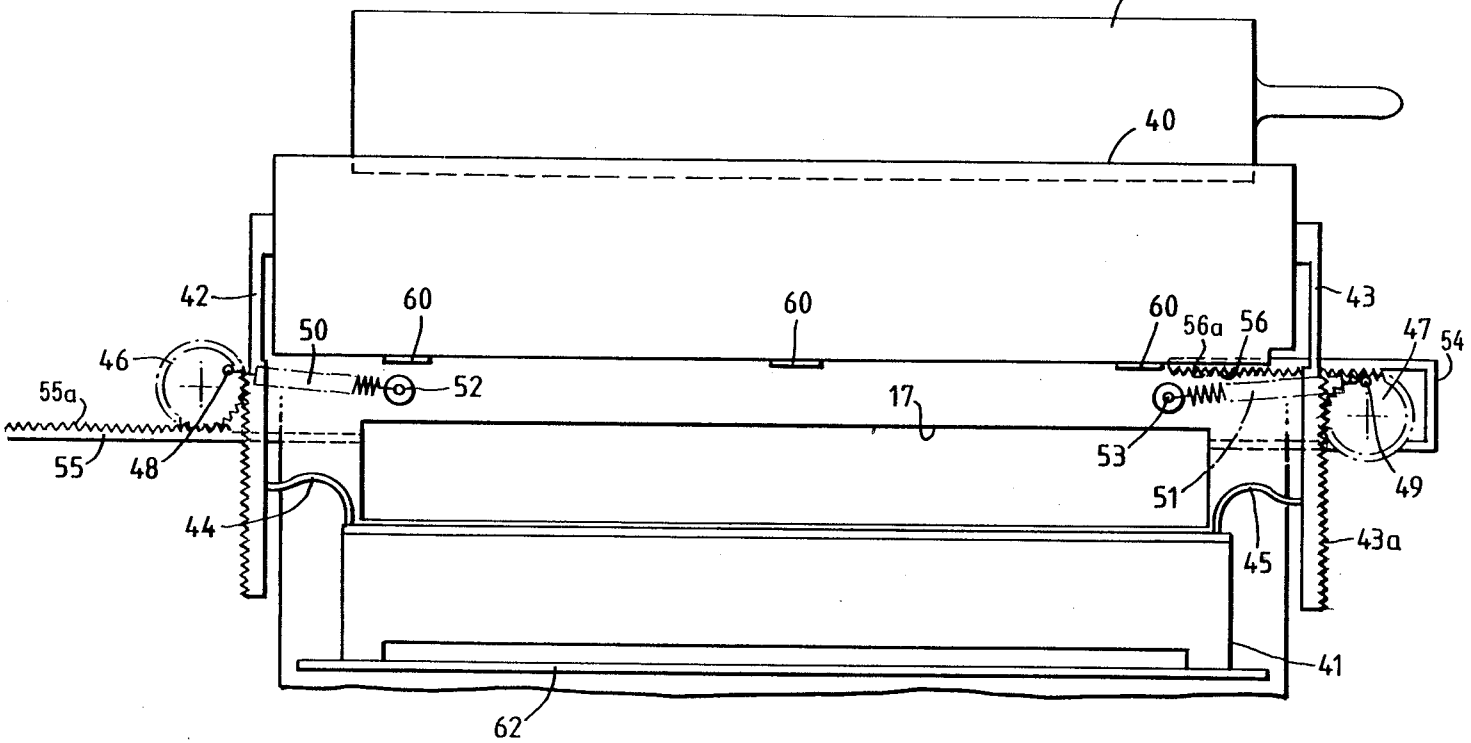

FIGS. 2 and 4 show the shutters 40 and 41 in their closed positions when the cassette 16 is removed from the main assembly 100 of the copier, and FIGS. 3 and 5 show the shutters in their open positions when the cassette 16 is inserted in its operative position in the main assembly of the copier.

Extending from opposite sides of sealing shutter 40 in the direction of movement of the shutters and integral therewith is a pair of bars 42, 43 having a respective toothed portion 42*a*, 43*a* on their outer sides at the ends remote from the sealing shutter 40, as can be seen most clearly in FIG. 5. The bars 42, 43 are substantially rigid in their longitudinal direction, but have a degree of flexibility in the direction transverse thereto to allow the sealing shutter 40 to move along a curved path over the developer roller 24 as discussed again below.

The opaque shutter 41 is physically linked to the bars 42,43 (and hence to the sealing shutter 40) by a pair of flexible straps 44,45. The straps 44,45 extend from opposite sides of the opaque shutter 41 and are attached to the inner sides of the bars 42, 43 respectively approximately midway along the toothed portions 42*a*, 43*a* on the opposite sides thereof.

It is noted here that the opaque shutter 41, the sealing shutter 40, the side bars 42,43, and the connecting straps 44,45 may suitably be molded as a one-piece unit from plastics material, such as for example polypropylene, polyethylene,or nylon.

The toothed portion 42*a* of the left hand side bar 42 meshes with the teeth of pinion 46 and the toothed portion 43*a* of the right hand side bar 43 meshes with the teeth of pinion 47. Both pinions 46 and 47 are rotatably mounted in the cassette housing. The pinions 46, 47 have a respective off-center peg 48,49 to which is attached a respective tension spring 50,51. The opposite ends of the springs 50,51 are attached to posts 52,53 extending from the base of the cassette housing. When the cassette 16 is removed from the main assembly of the copier the springs 50,51 bias the shutters 40,41 to remain in their closed positions shown in FIGS. 2 and 4 in which the sealing shutter 40 overlies the developer roll 24 and seals the developer housing 23 and the opaque shutter 41 covers the optics aperture 17 in the cassette housing 19.

When the cassette 16 is inserted into the main assembly of the copier the shutters 40 and 41 are automatically opened by an actuator 54 mounted integrally on main assembly of the copier, see FIG. 5. The actuator 54 comprises a bifurcated rack having a longer arm 55 extending below the cassette housing having at its remote end a toothed portion 55*a* engaging the left hand pinion 46 from below, as shown in FIG. 5. The bifurcated actuator 54 also comprises a shorter arm 56 extending into the cassette housing 19 and having a toothed portion 56*a* engaging the right hand pinion 47 from above as shown in FIG. 5.

It will be evident from studying FIG. 5 that this rack and pinion arrangement causes the pinions to rotate in opposite senses (and therefore impart equal linear motion to the side bars 42, 43) when the cassette 16 is moved relative to the actuator 54, i.e. when the cassette is withdrawn from or inserted into the main assembly of the copier.

FIG. 5 shows the fully opened position of the shutters 40 and 41 relative to the actuator 54 when the cassette if fully inserted in the main assembly of the copier.

When the cassette 16 (and hence the shutter assembly) is withdrawn from right to left as shown in FIG. 5 the arm 55 of rack 44 causes pinion 46 to rotate counterclockwise and the arm 56 of rack of 54 causes pinion 47 to rotate clockwise. This rotation of the pinions causes the side bars 42, 43 to be driven forward, i.e. in an upwards direction in the plane of FIG. 5. As the side bars 42, 43 are rigid in the direction of motion the sealing shutter 41 is moved by the side bars over the developer roll 24 to close and seal the developer housing 23. The sealing shutter may suitably be provided with clips 60 on its trailing edge which engage with a complementary lip 61 on the wall of the developer housing 23 to ensure optimum sealing. The sealing shutter 40 is made to follow an inclined and slightly curved path relative to the plane of the opaque light shutter 40 (see FIGS. 2 and 4), but this is simply accommodated by the resilience of the side bars 42, 43 in the direction transverse to their longitudinal direction, the side bars being retained by side guide members in the cassette housing defining their path of movement.

As the side bars 42,43 are driven forward when the cassette 16 is withdrawn, the opaque shutter 41 does not move until the slack in the flexible connecting straps 44, 45 has been taken up and then the opaque shutter 41 follows the movement of the side bars 42,43 until the optics window 17 in the cassette housing 16 is closed thereby. With reference to FIGS. 2 and 3 it will be seen that the opaque shutter 41, unlike the sealing shutter 40 moves in its own plane. Once the shutters 40,41 have been moved past the point where the pegs 48,49 cross the line defined by the posts 52,53 and the axes of the pinions 46,47 the springs 50,51 act in the opposite direction to urge the shutters into their closed positions.

Thus the sealing shutter 40 acts as an effective transit seal to prevent toner leaking from the developer housing 23 into other parts of the cassette and the opaque shutter 41 closes the optics aperture 17 in the cassette housing 16 to prevent contaminants from entering and also to shield the photoreceptor 1 from exposure to light.

When the cassette is reinserted into the main assembly of the copying machine for operation it is inserted from left to right as seen in FIG. 5. The arm 55 of rack 54 now causes pinion 46 to rotate clockwise, while the arm 56 of rack 54 causes pinion 47 to rotate anticlockwise. This rotation of the pinions causes the side bars 42,43 to retract, i.e. to move in the downward direction in the plane of FIG. 5. The sealing shutter 40 is consequently moved back away from the developer roll 24 to open the developer housing and when the slack of the flexible connecting straps 44, 45 has been taken up the opaque shutter 40 is also moved back to open the entire optics aperture 17 until it butts against stop 62. Once the shutters have been moved back past the points where the pegs 48,49 cross the line defined by the posts 52, 53 and the axes of pinions 46, 47 the springs 50,51 act in the opposite direction to bias the shutters towards their open positions.

It is noted here that the reason for using flexible connecting straps 44,45 between the opaque shutter 41 and the side bars 42,43 in the present embodiment is to enable different amounts of movement for the two shutters which is desirable to save space in the cassette when the optics aperture is of a different size to the opening of the developer housing. In this case the two shutters may be made to the minimum sizes necessary for satisfactory sealing and shielding, the permitting a compact configuration to be achieved.

The patents and applications referred to herein are hereby specifically and totally incorporated herein by reference.

While the invention has been described with reference to a specific embodiment it will be evident to a person skilled in the art that various modifications may be made within the scope of the present invention. For example, while the process unit has been illustrated as containing an integral cleaning unit and charging assembly these aspects of the overall machine may be contained within the main body of the printing machine. In addition, while the invention has been illustrated with respect to copying apparatus it will be understood that it may be used in printer apparatus wherein a light beam such as a laser beam may be used to selectively discharge portions of the photoconductor. Accordingly such modifications and embodiments as may readily occur to the artisan are intended to be within the scope of the appended claims.

I claim:

1. A process unit adapted to be removably mounted in a main assembly of an electrostatographic printing machine, comprising a housing , an imaging member inside the housing, which housing has a chamber for containing developer and an aperture through which the imaging member may be exposed to light, an opaque shutter adjacent the aperture, and a sealing shutter adjacent the developer chamber, wherein the opaque shutter and the sealing shutter are linked to form a unitary member which is slideably mounted within the housing and which is adapted to cooperate with actuating means provided on the main assembly of the printer whereby the opaque shutter and the sealing shutter are moved together to positions at which they respectively close the aperture and seal the developer chamber when the process unit is removed from the main assembly, and the opaque shutter and the sealing shutter are moved together to positions at which the aperture and the developer chamber respectively are open when the process unit is inserted in the main assembly of the copying machine.

2. A process unit as claimed in claim 1, wherein the opaque shutter and the sealing shutter are linked by a coupling which is flexible at least in the direction of movement of the shutters.

3. A process unit as claimed in claim 2 wherein the flexible coupling comprises a resilient strap.

4. A process unit as claimed in claim 1, wherein the unitary member comprises a pair of substantially parallel bars extending longitudinally in the direction of movement of the shutters, said shutters being disposed transversely between said bars.

5. A process unit as claimed in claim 4, wherein at least one of the bars is adapted to cooperate operatively with the actuating means on the main assembly via a respective pinion provided in the housing.

6. A process unit as claimed in claim 5, wherein both bars are adapted to cooperate operatively with the actuating means via respective pinions, wherein the pinions are arranged to be rotated in opposite senses.

7. A process unit as claimed in claim 1, wherein the unitary member is biased by spring means such that when the unitary member is moved past a predetermined position in one direction the shutters are urged by the spring means towards their closed positions, and when the unitary member is moved past the predetermined position in the opposite direction the shutters are urged by the spring means towards their open positions.

8. An electrostatographic printing machine comprising a main assembly and a process unit adapted to be removably mounted in said main assembly, said process unit comprising a housing, an imaging member inside the housing which housing has a chamber for containing developer and an aperture through which the imaging member may be exposed to light, an opaque shutter adjacent the aperture, and a sealing shutter adjacent the developer chamber, wherein the opaque shutter and the sealing shutter are linked to form a unitary member which is slideably mounted within the housing and which is adapted to cooperate with actuating means provided on the main assembly, said main assembly comprising actuating means adapted to cooperate with the unitary member of the process unit in such manner that the opaque shutter and the sealing shutter are moved together to positions at which they respectively close the aperture and seal the developer chamber when the process unit is removed from the main assembly, and the opaque shutter and the sealing shutter are moved together to positions at which the aperture and the developer chamber respectively are open when the process unit is inserted in the main assembly of the copying machine.

9. An electrostatographic printing machine as claimed in claim 8, wherein the opaque shutter and the sealing shutter are linked by a coupling which is flexible at least in the direction of movement of the shutters.

10. An electrostatographic printing machine as claimed in claim 9, wherein the flexible coupling comprises a resilient strap.

11. An electrostatographic printing machine as claimed in claim 8, wherein the unitary member comprises a pair of substantially parallel bars extending longitudinally in the direction of movement of the shutters, said shutters being disposed transversely between said bars.

12. An electrostatographic printing machine as claimed in claim 11, wherein at least one of the bars is adapted to cooperate operatively with the actuating means on the main assembly via a respective pinion provided in the housing.

13. An electrostatographic printing machine as claimed in claim 12, wherein both bars are adapted to cooperate operatively with the actuating means via respective pinions, wherein the pinions are arranged to be rotated in opposite senses.

14. An electrostatographic printing machine as claimed in claim 8, wherein the unitary member is biased by spring means such that when the unitary member is moved past a predetermined position in one direction the shutters are urged by the spring means towards their closed positions, and when the unitary member is moved past the predetermined position in the opposite direction the shutters are urged by the spring means towards their open positions.

15. An electrostatographic copying machine as claimed in claim 13, wherein the actuating means comprises a rack adapted to cooperate operatively with the pinions in the housing member.

16. An electrostatographic copying machine as claimed in claim 14, wherein the rack is bifurcated with one branch of the rack arranged to engage one of the pinions of the process unit and the other branch of the rack arranged to engage the other of the pinions.

* * * * *